United States Patent [19]

Krebs

[11] Patent Number: 4,930,054

[45] Date of Patent: May 29, 1990

[54] DUAL CONE RECESSED LIGHTING FIXTURE

[75] Inventor: Werner W. Krebs, Crestview Hills, Ky.

[73] Assignee: NuTone, Inc., Cincinnati, Ohio

[21] Appl. No.: 281,702

[22] Filed: Dec. 9, 1988

[51] Int. Cl.[5] ..... F21S 1/02

[52] U.S. Cl. ..... 362/149; 362/276; 362/295; 362/294; 362/373; 315/118

[58] Field of Search ..... 362/276, 145, 147, 148, 362/149, 294, 373, 802, 96; 315/118, 119; 362/346, 295

[56] References Cited

U.S. PATENT DOCUMENTS

| | | | |
|---|---|---|---|
| 2,799,773 | 7/1957 | Schwartz | 362/294 |
| 3,119,567 | 1/1964 | Schwartz | 362/294 |
| 3,786,233 | 1/1974 | Bumpus et al. | 219/343 |
| 4,293,899 | 10/1981 | Sanner | 362/294 |
| 4,302,801 | 11/1982 | Duddy | 362/294 |
| 4,358,635 | 11/1982 | Druffel | 174/101 |
| 4,388,677 | 6/1983 | Druffel | 362/276 |
| 4,450,512 | 5/1984 | Kristofek | 362/276 |
| 4,600,979 | 7/1986 | Fisher et al. | 362/373 |
| 4,630,182 | 12/1986 | Moroi et al. | 362/294 |
| 4,685,037 | 8/1987 | Akiyama et al. | 362/276 |
| 4,754,377 | 6/1988 | Wenman | 362/148 |

*Primary Examiner*—Ira S. Lazarus
*Assistant Examiner*—D. M. Cox
*Attorney, Agent, or Firm*—Wood, Herron & Evans

[57] ABSTRACT

A recessed lighting fixture for installation in an insulated ceiling uses a reflector assembly configuration to passively facilitate the movement of thermally induced air currents to distribute and communicate steady uniform air heated by the fixture lamp to a temperature responsive circuit interrupter. The reflector assembly includes a pair of concentric downwardly facing cones connected at their upper ends and sealed about the lamp socket. The cones are spaced, forming a cone shaped air gap therebetween. The space within the inner cone surrounding the lamp connects through holes at the upper end of the inner reflector with the gap between the cones. The lower rim of the outer cone is suspended above the lower rim of the inner cone to form an annular air passage connecting the lower end of the gap with the chamber between the housing and the outer reflector in which the circuit interrupter is positioned on the inside housing surface. Air heated by the lamp flows from the space around the lamp through the holes in the inner reflector, through the gap and through the anular space to the housing chamber where it circulates past the circuit interrupter.

28 Claims, 3 Drawing Sheets

DUAL CONE RECESSED LIGHTING FIXTURE

The present invention relates to recessed lighting fixtures, and to such fixtures having internal features for passively directing thermal air currents to prevent overheating. More particularly, the present invention relates to recessed lighting fixtures having thermal protectors to interrupt the lighting circuit to avoid overheating.

The increased use of recessed lighting has resulted in increased awareness of the hazards which recessed fixtures can produce as a result of overheating in certain applications. It has been recognized that recessed lighting fixtures, particularly ceiling mounted recessed fixtures, suffer an increased risk of fire when installed in contact with insulation.

Lighting fixtures intended for recessed installation in applications where the fixture will be in contact with insulation, known as Type IC lighting fixtures, will safely dissipate heat only at a certain maximum rate. Heat dissipation rate increases as temperature increases, and fixture temperature will increase until the heat dissipation rate equals the electrical power which is converted to heat within the fixture. Accordingly, each fixture design is assigned a maximum wattage rating at which the temperature will rise only to a safe level. This level is, according to some current standards, 65° C. above ambient temperature, ambient temperature for most test purposes being 25° C.

Notwithstanding the wattage limitation, hazards still exist when users "overlamp" such fixtures, that is, when they replace the lamps in such fixtures with lamps which exceed the wattage rating for which the specific fixture was designed. Standard incandescent lamps of different wattage ratings are provided with identical bases making the lamps interchangeable in most fixtures. As a result, the overlamping of a fixture can be so easily done that the likelihood that the wattage limitation will be exceeded is high. Thus, the risk of fixture overlamping and the resulting risk of fire is substantial.

In response to the existence of this risk, underwriting and building code requirements have been imposed to enhance the safety of such fixtures and to reduce the incidence of fire. The promulgators of such requirements have determined that it is necessary that recessed lighting fixtures which are intended for use in contact with insulation be provided with means for interrupting the lighting circuit in the event that the fixture is lamped at a wattage in excess of the designed limitation for the fixture. Accordingly, devices of the prior art have been proposed with thermal lighting circuit interrupters usually built into the lighting socket, or sometimes located elsewhere on the fixture.

It is recognized, however, that the fire hazard due to excessive power consumption by a fixture in contact with insulation is a hazard which increases with time as the fixture is operated. When the lamp in the fixture is energized above the design wattage limitation, electrical energy is converted to heat at a rate which is higher than that at which the heat dissipates from the fixture. In the case where the lamp wattage is excessively high, temperature will eventually reach a level which is unsafe. Typically, it has been found, and the applicable regulations so reflect, that the need for circuit interruption in the case of overlamping need be effective when the fixture's operation above the wattage limit is within a certain time duration. Lighting fixtures which are operated for short time periods will often not reach an unsafe operating temperature, even when lamped substantially above the fixture wattage rating.

A standard therefore has been adopted that any recessed lighting fixtured intended for installation in an insulated ceiling be provided with a circuit disconnect which will interrupt the circuit whenever the fixture is operated with a lamp above the fixture's noted wattage limitation for not more than a maximum time of three hours. Such a limitation has been adopted by Underwriters Laboratories in UL1571 Standard for Safety.

The prior art has encountered difficulty in providing a recessed lighting fixture which will operate to interrupt power to the lamp before lamps which exceed the rated wattage are used for periods in excess of a maximum time limit. Insulation properties and installation conditions vary. Thus, some prior art fixtures disconnect too soon or at too low a wattage in some typical installations, while others may not disconnect in time to satisfy the code requirement when the rated wattage limit is exceeded. A fixture which does not shut off within the code requirement is hazardous, while one which provides circuit interruption in periods substantially shorter than the maximum time limit or for lamp wattages within the wattage limit of the fixture is unacceptable in its performance in that it will not function when it should.

Therefore, there is a need to provide a recessed lighting fixture for installation in a ceiling in contact with insulation which is of such design that circuit interruption can take place and will take place only when the fixture is used with a lamp wattage in excess of a wattage limit, and only when it exceeds that limit for a period which is in excess of a specified period of time, but not in excess of a maximum period of time of, for example, three hours.

Accordingly, it is a primary objective of the present invention to provide a recessed lighting fixture for installation in an insulated ceiling which fills the need for reliable effective circuit interruption within a specified period of time when the fixture is overlamped. It is a further objective to provide such a fixture which will not interrupt the lighting circuit when operated with a lamp within the wattage rating, and will not interrupt the circuit too soon.

It is a more particular objective of the present invention to provide a recessed lighting fixture which utilizes passive features of the design to stabilize the heat flow through the fixture and to provide a stable and reliable temperature for sensing by a temperature responsive circuit interrupter.

The device of the present invention accomplishes the above objectives by providing a fixture structure which passively directs thermal currents and distributes heat accumulation in lighting fixtures designed for use in contact with insulation. The temperature distribution which results is such that a thermal protector positioned in the fixture housing will exceed a threshold temperature and thus interrupt the lighting circuit when, and only when, it is operated at a wattage in excess of a wattage limit, but within a predetermined amount of time. According to the present invention, the thermal distribution within the fixture is maintained by a unique double reflector assembly in the form of a nested cup pair which directs heat flow and convection currents to provide a reliable temperature level at the thermal sensor of a circuit interrupter so that the fixture disconnect occurs within acceptable limits of temperature and time.

According to the preferred embodiment of the present invention, a lighting fixture having a standard cylindrical shaped housing and designed to be installed in contact with insulation and recessed into a ceiling is provided a downwardly facing reflector assembly which includes a pair of spaced downwardly facing cups each having a reflector like surface. The reflector assembly includes an inner conical shaped reflector and an outer conical shaped reflector or reflector liner. The reflectors of the pair are related to each other so as to direct the air flow downwardly along and between their surfaces to near the lower rim of the housing from where it rises to produce a stable heat distribution within the housing.

In the preferred embodiment, the liner is mounted at its upper end to the inner reflector. These inner and outer reflectors are conical in shape and are spaced from the other along their side walls so as to form a cone shaped air gap between them. The lower end of the side wall of the outer reflector or liner stands above that of the inner reflector so as to form an annular opening around the base of the reflector assembly to the interior of the housing from the gap between the reflector components. Spaced openings are provided around the upper end of the inner reflector cone. These openings connect the space within the inner reflector which contains the lamp with the upper end of the gap between the reflector cones. Openings are also provided around the lower edge of the inner cone to allow air from the housing interior to enter the space containing the lamp.

When the fixture is operated, heat is generated by the incandescent lamp in the socket. This heating heats the air in the space around the lamp and heats the inner reflector. This causes the air to rise to the upper end of the inner reflector from where it passes through the holes in the upper end of the inner reflector and into the gap between the two reflectors. The heated air entering this gap picks up additional heat from the inner reflector wall and also cools by contacting the wall of the outer reflector or liner.

The air in the gap is ultimately forced to move downward between the reflectors due to the cooling of this air and its displacement by the more greatly heated air entering the gap near the top. The downwardly moving air in the gap gradually exits the gap through the annular base between the lower edges of the two reflectors and passes into and rises within the housing area surrounding the outer reflector. This heated air rising within the housing cools and descends within the housing causing a general circulation of air within the housing. As the air in the housing circulates, it flows around a thermal detector mounted on the inside of the exterior housing wall. The coolest air in the housing moves to the bottom where some reenters the inner reflector through the holes at its lower rim.

In addition to the convection currents, heat is conducted through the inner and outer reflectors. Both the air circulation pattern thus generated and the two layers of reflector surface conductors cooperate to more uniformly regulate the flow of heat from the lamp and to and through the outer housing wall. This provides a more uniform steady state heat transfer system than has been found in the prior art. As such, a thermal protector can be selected with a threshold protection level which will be exceeded when and only when a lamp of excessive wattage is used in the fixture. When one is so used for an excessive amount of time, the thermal protector will interrupt the lamp circuit. Otherwise, the steady flow of heat through the housing wall will, given the amount of expected insulation, be nonetheless sufficient to extract sufficient heat to keep the thermal protector device at a temperature below its operational threshold so that the circuit will not interrupt prematurely or at too low a wattage.

An advantage of the present invention and of the dual cone structure in particular is that it provides substantial surface area for transfer of heat, and directs the air stream in such a way as to move and distribute the heat so that a uniform and predictable temperatures will occur at the thermal protector to insure that the circuit shutoff within a prescribed amount of time will occur when, and only when, the wattage criteria have been satisfied, within acceptable tolerances.

A further advantage of the invention has been found to be that differences in lamp type, such as between type A or type R lamps, or changes in, or addition or removal of, lens has little effect on the performance of the desired circuit interrupter setting.

These and other objectives and advantages of the present invention will be more readily apparent from the following detailed description of the drawings in which.

Figure 1:
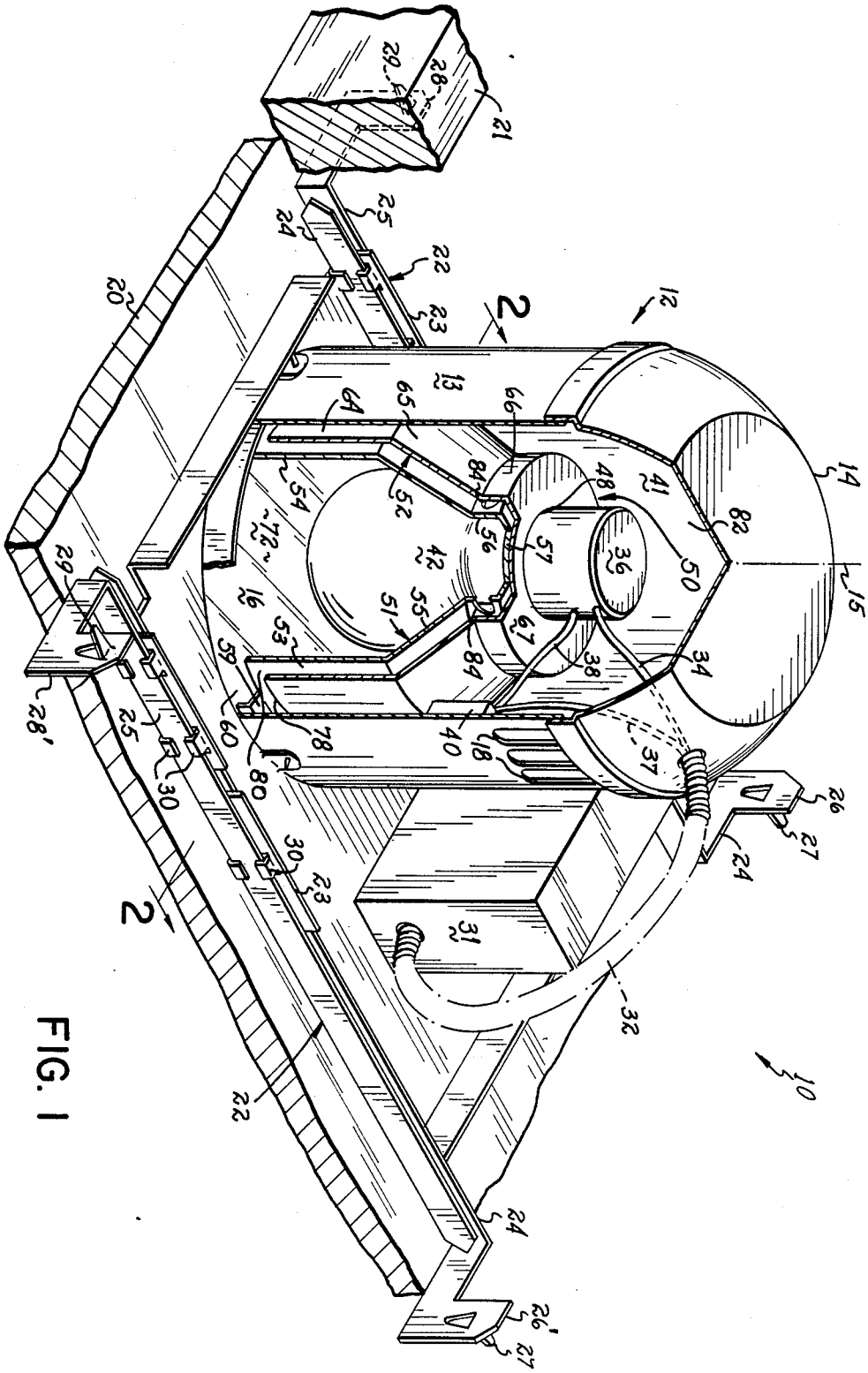
FIG. 1 is an isometric view, partially broken away, showing an installed and operable lighting fixture according to principles of the present invention.

Referring to FIG. 1, a lighting fixture 10, according to principles of the present invention, is illustrated. The fixture 10 includes a housing 12 with a generally cylindrical side wall 13 of sheet metal, preferably aluminum. The housing 12 has a dome-shaped circular cap 14 at its upper end having a vertical axis 15, and having a circular opening 16 at its lower end with a center also lying on the axis 15. A small number of slots 18 are provided through the side wall 13 of the housing 12. The cylindrical housing 12 has a generally vertical central axis which is concentric with the axis 15 when installed in a ceiling 20.

The housing 12, when installed, is typically mounted to ceiling joists 21 in the ceiling 20 through an adjustable housing frame or plaster frame 22. The frame 22 has a turned up edge 23 with a pair of horizontally extending frame members or hanger bars 24 and 25 mounted to slide horizontally thereon with ends adapted for rigidly but adjustably mounting the fixture 10 to ceiling joists 21. The frame 22 is conventional and formed usually of sheet steel, preferably galvanized steel. The frame 22 is rigidly secured to the lower end of the housing 12. A first adjustable member 24 and a second adjustable member 25 are mounted to slide horizontally with respect to the upturned edge 23 of the frame 22 and with respect to each other.

The mounting frame adjustable members 24 and 25 are slidably attached to the member 23 through a plurality of pairs of opposed rail tabs 30 formed in the fixed edge 23 of the frame 22, so as to permit the frame 22 to be expanded horizontally to adjustably mount between an adjacent pair of ceiling joists. A pair of feet 26, 26' are formed in one of the ends of the member 24, having formed therein nailing points 27 to make the member securable to the side of a first one of the ceiling joists 21.

A pair of adjustable feet 28, 28' are formed in the end of the adjustable member 25 with nailing points 29 therein to connect to a second and adjacent one of the ceiling joists 21 to mount the fixture in the ceiling 20.

On top of the frame 22 near the outside of the housing 12 is rigidly secured an electrical junction box 31 into which branch circuit wiring of the building in which the fixture is being installed terminates. Within the junction box 31, the branch wiring (not shown) connects with the fixture wiring which extends through a flexible conduit 32 through the wall of the cap 14 and into the interior of the housing 12. The fixture wiring includes a grounded supply conductor 34 which is connected to the threaded screw shell, (not shown) of a lamp socket 36, and a second conductor 37 which connects to the ungrounded supply conductor 38 which connects to the contact in the center of the base of the socket 36. Connected in series with the conductor 38 is a thermal circuit interrupter 40. The thermal circuit interrupter 40 is mounted on the inside surface 41 of the cylindrical side wall 13 of the housing 12, and preferably at approximately or slightly below the level of the socket 36 as shown in the illustrated embodiment.

The socket 36 is positioned to receive an incandescent light bulb 42, with the base of the lamp 42 extending upwardly and threaded into the interior of the socket 36 with its terminals contacting the power terminals within the socket 36 (not shown). The wiring of the circuit and the electrical connections are conventional.

A concentric socket receiving hole 48 is provided in the center of a downwardly facing conical shaped reflector assembly 50 which supports the lamp socket 36 with respect to the frame 22 and the housing 12. The socket 36 is positioned in the hole 48 and clips therein to the top of the reflector assembly 50. The details of the reflector assembly 50 and its mounting connections are better illustrated in FIG. 2.

Figure 2:
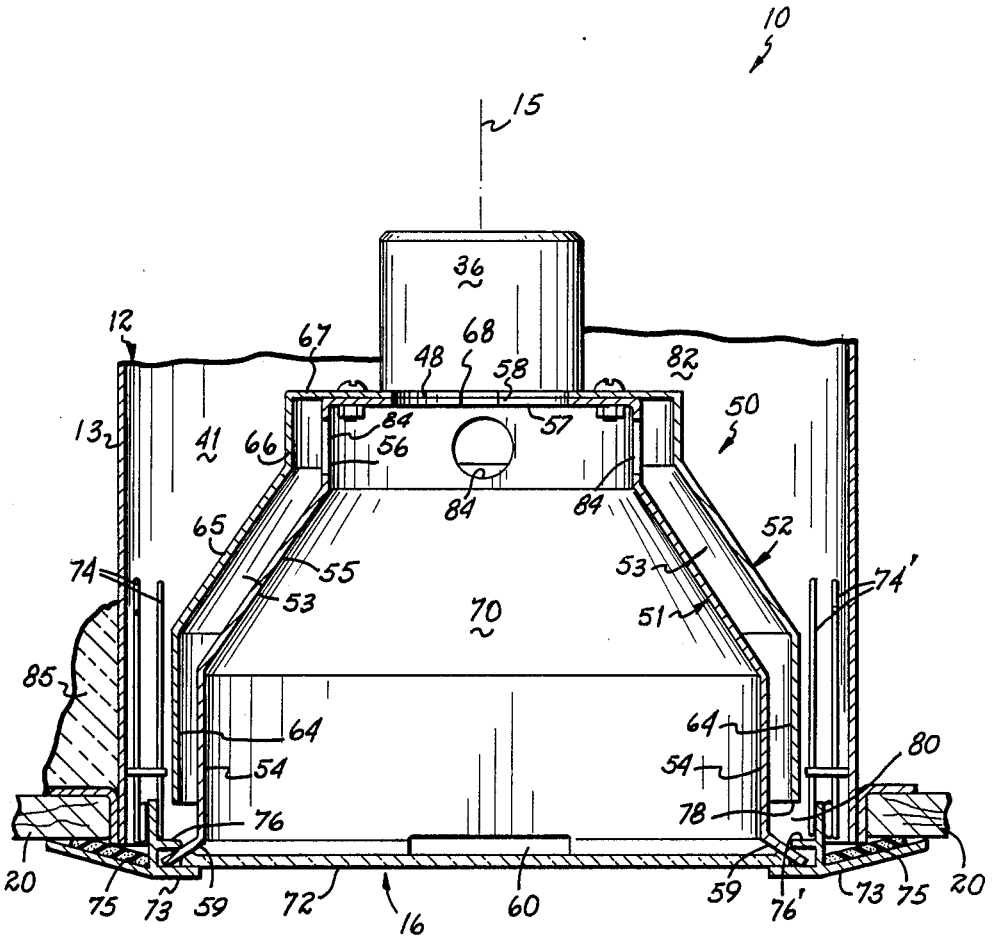
FIG. 2 is a cross-sectional elevational view taken alone line 2—2 of FIG. 1.

Referring to FIG. 2, the reflector assembly 50 has a generally overall conical shape with its vertical axis on the axis 15 of the housing 12. The reflector assembly 50 includes an inner cup or reflector 51 and an outer cup or reflector 52 overlying and surrounding the inner reflector 51 and spaced therefrom to define an air gap 53 therebetween. Both the inner reflector 51 and the outer reflector or liner 52 are generally conical in shape and face downwardly, each having a vertical axis on the axis 15 of the housing 12, arranged generally as a pair of nested cups. Each of the reflectors 51 and 52 is formed of a single piece of sheet material, preferably aluminum, spun so as to define a circle in every horizontal plane about the axis 15.

The inner reflector 51 includes a lower cylindrical section 54, a downwardly facing frustoconical section 55 and an upper cylindrical section 56 having a smaller diameter than that of the lower cylindrical section 54. The conical section 55 connects and is formed integrally with the cylindrical sections 54 and 56. At the top of the reflector 51, there is an inwardly turned end flange 57 integrally formed at the upper end of the cylindrical section 56 and forming the top the reflector 51. In the flange 57 is a circular mounting hole 58 for the lamp socket 36. The hole 58 is a portion of the socket hole 48 of the reflector assembly 50. The lower end of the cone 51 terminates in a frustoconical shaped lip 59 formed integrally of the material from which the reflector 51 is formed and extending downwardly and outwardly from the lower edge of the cylindrical section 54. In the lip 59 is a pair of diametrically spaced air passages or notches 60.

The outer reflector or liner 52 is formed in three sections similar to those of the inner reflector 51. The first section of the outer reflector 52 is a lower and larger cylindrical section 64. The second or central section is a frustoconical portion 65, and the third or upper section is a smaller cylindrical section 66 having a diameter less than that of the lower cylindrical section 64. The upper end of the reflector 52 also has inwardly facing flange 67 which overlies the flange 57 of the inner reflector and is riveted or otherwise fastened to it to support the outer reflector 52 upon and concentrically with the inner reflector 51 to suspend the outer reflector 52 so it surrounds the inner reflector 51 in spaced relationship with it and defining the gap 53 between the reflectors 51 and 52.

The outer reflector 52 also has therein a hole 68 therethrough which is similar to hole 58 of the lower reflector 51 and concentric therewith, together with it making up the socket mounting hole 48 of the reflector assembly 50. Preferably, the hole in 52 is slightly smaller than the hole 58 in reflector 51 so the lamp socket and spring clip fits closely only in hole 68 thus simplifying alignment. Through this hole the base of an incandescent lamp is threaded into the socket 36 from a space 70 defined within the inner reflector 51 between the reflector 51 and the lower circular opening 16 in the housing 12.

The lower end of the space 70 may be, as in the illustrated embodiment, closed by a glass lens 72 which is supported upon an annular lens holder 73. A pair of clip springs 74, 74'; linked to the top of the holder 73 across a diameter thereof, are hooked to the housing 12 and are biased so as to draw the lens holder 73 upwardly against the ceiling 20 to which the fixture 10 is mounted and to form a seal therewith by compressing a gasket 75 between the holder 73 and the ceiling 20. The primary purpose of the gasket is to prevent light leakage between a possibly rough or uneven ceiling and annular lens holder 73. It also restricts air flow around the lens. The gasket 75 is annular in shape and overlies the holder ring 73.

The reflector assembly 50, including the lamp socket 36 which it supports, is mechanically connected to, and supported upon, the lens holder ring 73 through a bayonet action clip lugs 76, 76' formed therein. As such, the entire reflector assembly 50, including the socket 36 and lamp 42, are removable as a unit from the housing 12. The spring clips 74, 74', however, prevent complete removal of the reflector assembly 50 from the housing 12 without further disassembly. This protects the wiring 34 and 38 which connects the socket 36 with the terminal box 31, but allows for replacement of the lamp 42.

The lower cylindrical section 64 of the outer reflector 52 has a circular lower edge 78 which defines the lower end of the reflector 52 in a plane above a lower flange 59 of the inner reflector 51. An annular opening 80 is thus defined between the edges 54 and 78 of the respective inner and outer reflectors 51 and 52. The annular opening 80 surrounds the lower section 54 of the inner reflector 51. The opening 80 forms a communicating air passage between the gap 53 which lies between the respective inner and outer reflectors 51 and 52 and an inner housing chamber 82. The chamber 82 surrounds the reflector 50 and socket assembly 36 within the cylindrical wall 13 of the housing 12.

At the upper end of the inner reflector 51 in the vertical side wall of the cylindrical upper section 56 are four spaced circular holes 84 which connect the inner reflector space 70 with the gap 53. The fixture 10, thus constructed, is suitable for recessed installation in a ceiling 20 where it will be surrounded by insulation 85 as will be explained more fully below.

Figure 3:
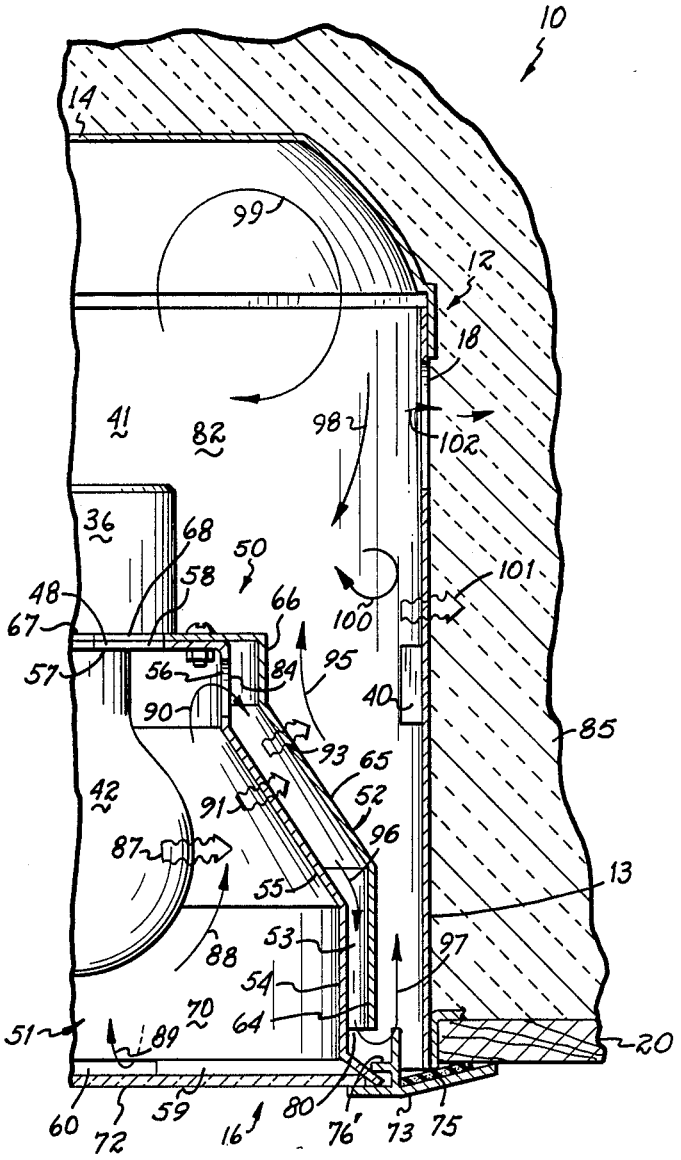
FIG. 3 is a diagram of a portion of FIG. 1 illustrating schematically the air flow and heat transfer in the lighting fixture of FIG. 1.

Referring now to FIG. 3, the function of the design of the fixture 10, according to principles of the present invention, is illustrated. As shown in FIG. 3, the lamp 42, when energized, is a source of heat. As the lamp 42 heats, air within the chamber 70 is warmed by heat passing in the direction of the arrow 87 from the lamp 42. This warmed air rises as shown by arrow 88, drawing in cooler air behind it, as illustrated by the arrow 89, through the notches 60 in the rim 59 of the lower reflector 51. The air flow in the direction of arrow 89 is from the chamber 82 within the housing 12 into the inner space 70 within the reflector 51. The warmed air rising in the direction of arrow 88 fills the volume surrounded by the upper section 56 of the inner reflector 51 and passes in part through the holes 84, as shown by the arrow 90, into the gap 53 between the inner reflector 51 and the outer reflector 52.

The warmed air within the volume 70, as well as the heat radiated from the lamp 42, warms the surface of the inner reflector 51 causing heat to be conducted therethrough, as indicated by arrow 91, to warm the cooler air in the gap 53. The air in the gap 53 further loses heat through the wall of the outer reflector 52 as indicated by the arrow 93. This heat causes air to be warmed in the chamber 82 adjacent the outer surface of the reflector 52. This air will have a tendency to further rise within the housing 12 as indicated by the arrow 95.

In the gap 53, this general circulation causes convection currents to flow in the directions of arrows 96, as the air cools in the gap 53, and in direction of the arrow 97, as air which has been warmed in the gap 53 rises past the cooler air of the chamber 82. The tendency of the heated air in the chamber 82 to rise increases as this air acquires additional heat from the warm reflector assembly 50 and the socket 36. As warmed air rises in chamber 82, air in the chamber 82 is also simultaneously cooled by the walls 13 of the housing 12 and descends as shown by arrow 98, causing a convection current of air to circulate within the chamber 82 as further shown by the arrows 99 and 100. This movement of slowly warming air, shown by arrow 97, will wash the thermal detector 40 in a stream of relatively uniformly heated air. The heat from the chamber 82 very gradually is conducted in the direction of the arrow 101 through the cylindrical wall 13 and end cap 14 of the housing 12. Additionally, minor portions of the air carrying heat flow in the direction 102 through small holes such as the holes 18 in the wall 13 of the housing 12 into the insulation 85.

Eventually, a steady temperature state will be reached within the chamber 82, unless the circuit is interrupted before that occurs. This temperature will vary somewhat, depending on the installation, the insulation, and other variable factors.

According to design criteria well known by those in the art, a threshold temperature setting at which the thermal protector 40 will interrupt the circuit to the socket 36 can be established. With lamp 42 of any given wattage, the heat flow from the lamp 42 into the volume 70 within the reflector assembly 50, through the gap 53 and into the chamber 82, and from the chamber 82 through the housing 12 into the insulation 85, will proceed at rates determinable by calculation, but more easily by measurement methods well known in the art. Ultimately, the steady state temperature will be reached in the vicinity of the thermal protector 40. This temperature will be a safe temperature when the lamp 42 is at or below the wattage at which the fixture 10 together with a given lens 72 and trim 73, is rated. Thus, the thermal protector 40 will be set or selected to interrupt the lamp circuit only at a temperature at or above this steady state temperature.

A threshold of this thermal protector 40 must, however, be selected so that if the lamp 42 exceeds the rated wattage of the fixture 10, the temperature in the vicinity of the thermal protector 40 will cross the threshold temperature set by a protector 40 before it reaches the steady state temperature, and will do so within a specified maximum time from the energization of the lamp 42. Thus, the circuit can effectively interrupt current to the lamp 42 so as to disconnect the fixture within the time period determined to be essential to provide safety for lamps exceeding the rated wattage of the fixture 10.

Standard lamp wattages are, for example, 40, 60, 75, 100, 150, etc. watts. Thus, they will be found to differ from the next closest available wattage by amounts of $\frac{1}{4}$, $\frac{1}{3}$ or $\frac{1}{2}$ in typical cases. With the double reflector design of the present invention, a selection of the threshold can be easily determined at which the protector 40 will interrupt the circuit as desired. Such a threshold will lie between the steady state temperature which would eventually develop in the vicinity of the thermal protector 40 when a lamp at the next higher wattage increment above the rated wattage of the fixture is employed, and the steady state temperature of a lamp at the wattage rating. Preferably, the threshold will be set as high as possible, but not too high to reliably interrupt, within the prescribed time requirement, the circuit when a lamp of the next highest standard wattage above the rated wattage is employed. The prescribed time requirement is 3 hours according to currently applicable standards. At the same time, it will be possible, with the present invention, for such setting to be easily made so as to fall above the steady state temperature expected in the vicinity of the thermal protector when a lamp of the rated wattage is employed, regardless of the time of operation.

Accordingly, the lighting fixture of the present invention achieves the objectives set forth above and provides the advantages enumerated herein as well as other advantages.

Accordingly, what is claimed is the following:

1. A thermally protected lighting fixture for recessed ceiling installation where the fixture will be surrounded by insulation, said fixture comprising:

a housing having an inside surface, an outside surface, and a downwardly facing open lower end, said outside surface being capable of contacting insulation when the fixture is installed in an insulated ceiling;

means for mounting the fixture to a ceiling so as to support said fixture with at least a portion of said housing above said ceiling and in contact with the insulation;

a downwardly facing reflector assembly supported from said housing and positioned in said housing across said open end to form a chamber between said reflector assembly and said inside surface of said housing;

said reflector assembly including an inner reflector, having a lower rim adjacent said housing opening, said inner reflector defining therein and surrounding an interior space above said rim;

said reflector assembly further including a downwardly concave outer reflector liner overlying at least a portion of said reflector and mounted spaced from said inner reflector so as to define an air gap between said liner and said inner reflector;

said liner having a first air passage therein spaced above said housing open end and above said inner reflector rim, said first air passage communicating said gap near the bottom thereof with said chamber;

said inner reflector having a second air passage therethrough connecting said space with said gap above said first passage;

a lamp socket mounted on said fixture so as to support a lamp within said space, and electrical conductors connected to said socket for connecting said lamp in a circuit with a power source; and temperature responsive circuit interrupter means mounted inside of said housing in said chamber above said first passage, said interrupter including temperature sensor means electrically connected in said circuit and operative for interrupting said circuit in response to a predetermined temperature condition.

2. The fixture of claim 1 wherein:

said outer reflector is mounted on said inner reflector; and said inner reflector is supported on said housing.

3. The fixture of claim 2 wherein said outer reflector is connected at its top to the top of said inner reflector.

4. The fixture of claim 1 wherein said reflectors are downwardly facing concentric cones.

5. The fixture of claim 1 wherein said inner reflector is sealed at its lower rim to said housing near the open end thereof so as to generally close said chamber within said housing.

6. The fixture of claim 5 wherein said inner reflector has therein near said rim a third passage connecting said space with said chamber.

7. The fixture of claim 1 further comprising:

a trim ring across said opening and supported on said housing, and said inner reflector being supported at its lower rim on said trim ring.

8. The fixture of claim 7 wherein said trim ring includes a seal for sealing said space and said chamber at the ceiling.

9. The fixture of claim 8 further comprising a lens supported by said trim ring so as to cover said opening and close said space between said inner reflector and said lens.

10. The fixture of claim 1 wherein said second passage includes a plurality of holes through said inner reflector at the upper end thereof.

11. The fixture of claim 1 wherein said outer reflector has a lower rim spaced above the lower rim of said inner reflector and said second passage is an annular space between said two rims.

12. The fixture of claim 1 wherein said circuit interrupter is positioned in the path of thermally induced air currents within said chamber.

13. The fixture of claim 1 wherein said temperature condition is a temperature threshold which will be exceeded only when a lamp exceeding a predetermined wattage is operated in said fixture.

14. The fixture of claim 13 wherein said temperature threshold is such that it will be exceeded at said circuit interrupter within a predetermined time of operation of said fixture.

15. The fixture of claim 14 wherein said predetermined time is three hours.

16. The fixture of claim 1 wherein said housing is cylindrical in shape and has a vertical axis and said reflectors are downwardly facing cones concentric about said axis defining said gap as a downwardly facing cone shaped air layer therebetween.

17. A thermally protected lighting fixture for recessed ceiling installation where the fixture will be surrounded by insulation, said fixture comprising:

a cylindrical housing having a vertical axis, a side wall, a closed upper end, and a downwardly facing open lower end, said side wall and said upper end each having an inner surface and each having an outer surface for contact with the insulation when installed in the ceiling;

an adjustable mounting frame rigidly attached to said housing and connectable to a ceiling for installing said fixture with said opening substantially flush with said ceiling;

a downwardly facing reflector assembly including a pair of downwardly facing generally conical reflectors, said reflectors being concentric with each other and with said cylinder, both connected together at their upper ends, and each having side walls radially spaced from each other to define a gap therebetween, said inner reflector having a lower rim connected to said cylinder near said opening to close such opening and to form a chamber between said outer reflector and the inside surface of said housing;

said outer reflector having a lower circular edge surrounding and spaced above said housing opening and said inner reflector rim to define a first air passage connecting said gap with said chamber;

a downwardly facing lamp socket mounted at the upper end of said reflector assembly, concentric therewith, and extending therethrough for receiving from inside said inner reflector the base of a light lamp therein, said socket having a pair of contacts for connecting said lamp to a power circuit;

said inner reflector defining a space between said socket and the lower rim of the inner reflector, said space surrounding said lamp when said lamp is received in said socket, said inner reflector having a plurality of holes at the upper end thereof and spaced around said socket, said holes defining a second air passage connecting said space and said gap;

electrical conductors connected to said contacts and connectable to a source of electrical power for forming an electric circuit with said lamp to energize said lamp;

a temperature responsive circuit interrupter mounted on said housing side wall near the inside surface of said housing, above said lower edge of said second reflector and below said upper end of said housing, said interrupter being connected in said electrical circuit in series with said socket contacts and being responsive to a predetermined maximum temperature to interrupt said circuit;

a lens assembly mounted across said open lower end of said housing closing said housing open end and enclosing said space within said inner reflector; and said inner reflector having a third air passage near its rim connecting said space with said chamber, said circuit interrupter being set to operate to interrupt said circuit within a predetermined time period during which said lamp has been energized at a wattage exceeding a predetermined level and to maintain said circuit uninterrupted when said lamp is energized at a wattage not exceeding an established level below said predetermined level.

18. A thermally protected lighting fixture comprising:

a housing having an inside surface, a top, a side wall and a downwardly facing open lower end;

temperature responsive circuit interrupter means mounted on the inside surface of said housing between its top and its lower end, said interrupter having a temperature sensor connected thereto for sensing a temperature condition, said interrupter means being operative to de-energize said lamp in response to a predetermined temperature condition at said sensor;

an outer cup having a downwardly facing lower end, said outer cup being mounted within said housing to define an outer air chamber within said housing between said outer cup and said housing;

an inner cup having a downwardly facing lower end, said inner cup being nested within said outer cup, said inner and outer cups defining an air gap therebetween, said inner cup defining an inner space therein above its open end;

means for supporting and energizing an electric lamp in said inner space whereby air in said space becomes heated;

means proximate the upper end of said air gap for providing a first air passage from said space to said gap so as to enable air heated in said space to flow from said space and into said gap;

said outer cup including surface means substantially continuous above the lower end of said outer cup for preventing the passage of heated air from said air gap to said chamber; and means proximate the lower end of said air gap for providing a second air passage from said air gap to said chamber at a level above the lower end of said inner cup to enable heated air entering said gap near its upper end from said inner space to flow downwardly in said air gap between said cups and into said chamber and thence upwardly within said chamber past said sensor.

19. The fixture of claim 18 wherein:

said outer cup is mounted on said inner cup; and said inner cup is supported on said housing.

20. The fixture of claim 18 wherein said outer cup is connected at its top to the top of said inner cup.

21. The fixture of claim 18 wherein said cups are downwardly facing concentric cones.

22. The fixture of claim 18 wherein said inner cup is sealed at its lower rim to said housing near the open end thereof so as to generally close said chamber within said housing.

23. The fixture of claim 18 further comprising:

a ring across said opening and supported on said housing, and said inner cup being supported at its lower end by said ring.

24. The fixture of claim 23 further comprising a lens supported by said ring so as to cover said open end of said housing and close said space between said inner cup and said lens.

25. The fixture of claim 18 wherein said sensor is positioned in the path of thermally induced air currents within said chamber.

26. The fixture of claim 18 wherein said temperature condition is a temperature threshold which will be exceeded only when a lamp exceeding a predetermined wattage is operated in said fixture.

27. The fixture of claim 26 wherein said temperature threshold is such that it will be exceeded at said circuit interrupter within a predetermined time of operation of said fixture.

28. The fixture of claim 27 wherein said predetermined time is three hours.

* * * * *